US006599201B1

(12) United States Patent
Grant

(10) Patent No.: US 6,599,201 B1
(45) Date of Patent: Jul. 29, 2003

(54) WEIGHT TRAINING APPARATUS

(76) Inventor: Christopher John Grant, 132 Whitestile Road, Brentford Middlesex (GB), TW8 9NJ ( * ) Notice: Subject to any disclaimer, the term of this patent is extended or adjusted under 35 U.S.C. 154(b) by 0 days.

(21) Appl. No.: 09/735,198

(22) PCT Filed: Jun. 10, 1999

(86) PCT No.: PCT/IB99/01268

§ 371 (c)(1),
(2), (4) Date: Dec. 8, 2000

(87) PCT Pub. No.: WO99/64113

PCT Pub. Date: Dec. 16, 1999

(30) Foreign Application Priority Data

Jun. 10, 1998 (GB) ..... 9812458
Aug. 21, 1998 (GB) ..... 9818350
Apr. 28, 1999 (GB) ..... 9909817

(51) Int. Cl.[7] ..... A63B 53/06; A63B 53/16; A63B 69/36

(52) U.S. Cl. ..... 473/256; 473/519; 473/226; 473/437

(58) Field of Search ..... 473/256, 437, 473/234, 238, 226, 251, 340, 519, 524, 553

(56) References Cited

U.S. PATENT DOCUMENTS 190,150 A 5/1877 Lozier
3,758,117 A 9/1973 Harrison
3,863,933 A * 2/1975 Tredway ..... 362/102
4,252,316 A 2/1981 Price
4,809,975 A * 3/1989 Lee ..... 473/256
4,984,801 A 1/1991 DeBack
5,178,394 A 1/1993 Tanampai
5,460,378 A 10/1995 Getts
5,720,695 A 2/1998 Eckmann
5,776,006 A 7/1998 Gruber
6,083,116 A * 7/2000 Loredo ..... 473/328
6,328,666 B1 * 12/2001 Manory ..... 473/437

* cited by examiner

*Primary Examiner*—Paul T. Sewell
*Assistant Examiner*—Mitra Aryanpour
(74) *Attorney, Agent, or Firm*—Reinhart Boerner Van Deuren, s.c.

(57) ABSTRACT

A golf muscle weight training apparatus for attachment to the shaft of a golf club or other sports implement includes a weight carrier having an elongated weight supporting portion, a weight, and a clamp mechanism. The clamp mechanism cooperates with the weight carrier to clamp the weight carrier to the shaft with the axis of the weight supporting portion extending substantially perpendicular to a plane extending through the axis of the shaft and being offset laterally with respect to the axis of the golf club. The weight supporting portion supports a weight mass, with the weight mass extending in overlying relation with the head of the golf club. In another embodiment, the axis of the weight mass extends perpendicular to the axis of the golf club shaft. One or more extension weights can be coupled to the weight carrier to increase the weight mass of the weight training apparatus.

21 Claims, 12 Drawing Sheets

WEIGHT TRAINING APPARATUS

BACKGROUND OF THE INVENTION

This invention relates to a golf muscle weight training apparatus which develops strength, suppleness and memory in the muscles used for swinging a golf club.

Golf muscle development is advocated by teaching professionals, golf magazines, instruction books, and is used by playing professionals and, to some extent, the keen golfer. Every time a golf club is swung, the golfing muscles are getting a work out. It can take a long time of natural swinging to develop peak muscle conditioning and timing. To quicken the muscle development process, it is possible [is] to use resistance weight training methods, of the correct form, to first help develop and secondly keep in shape the golfing muscles. Resistance weight training has proven itself in other sports and in general fitness.

To some extent golf is not a natural sport, as the down swing requires a pulling down and through action of the left side, which is the weak side of a right handed person. The right side has a tendency to take over, with disastrous results. The left side needs to be developed together with a suitable golfing technique. The main strength areas of interest are the fingers, hands, wrist, arm, shoulders and leg muscles for both left and right sides. One method of overall muscle development is to exercise with a weighted golf club. Some methods of providing a weighted club system for muscle resistance training include adding lead weight to a golf club head. This produces a permanently non adjustable customized club. Another method is to literally swing with two or three golf clubs nested together. This is a simple at hand method of weighting training, warming up and loosening the muscles for practicing and prior to playing. A further method is to add a donut-shaped lead or rubber weight which can be slotted on, or pushed over the shaft. Using free weights or weight training machines is a method of general muscle development which is popular for general fitness. Further methods include commercially available specialist weighted clubs and systems. Some examples of these are the "Protator" training device, "Swing Right" training aid and "Power Swing Fan" apparatus. All of the methods of developing the golfing muscles have drawbacks that can be improved upon.

Golf, like most sporting activities, uses muscles which are not used to a great extent in normal everyday occupation, where all golfers can benefit from regular practice. If a golfer can not play often or get to the driving range, it is convenient to use a weighted club at home, and especially indoors during the winter period, to develop and keep the muscles in condition.

Adding lead weight to the head of a golf club generally renders that club only usable for the specific purpose of weight training. Customised lead weighted clubs are not commonly available, although they can usually be made up by a club making professional. This method is less accessable to the common golfer. As a product, they are not available as an off the shelf item, and some knowledge of a specialised product is first required and is not widely known. In addition, the mass and position of the weight is fixed and can not easily be added to, or removed. Generally a [wooden] wood is used for this purpose, since to attach enough weight to be useful, a large hollowed out head is first required. The fact that a long length club is also generally used, together with the different hitting action of a wood, as compared to a shorter iron, is also restrictive. The lead can be attached to an iron club, but the weight needs to be fixed securely, for example, by bolting, this renders the club only suitable for weight training and the club can not be reinstated for normal use if holes have be made in the club head or shaft. Because the leaded club is produced to order, it is relatively expensive. Carrying an extra weighted club in a golf bag for warming up purposes prior to playing is not very convenient, takes up valuable club space, adds extra weight to the bag and is embarrassing if the number of clubs that are carried in a round of golf exceeds the rules.

Swinging with two or three golf clubs nested together requires the golfer's hands to span too large a grip diameter. This method is relatively uncomfortable and too dissimilar to the normal method of gripping. In addition, with this makeshift method, there is little flexibility in the amount of weight that can be used, the clubs are of uneven lengths, making the swing awkward. It is very inconvenient handing two or three clubs at once.

Adding a donut-shaped lead or rubber weight to a golf shaft has the disadvantage that, unless it is fixed, it can slide along the shaft causing injury to the hands and may damage the surface of the shaft. A single rubber donut weight does not add enough weight to be of practical value. Since the weight is only located centrally around the axis of the shaft, the affect of the club head and hitting the ball is not taken into account, as are clubs that are weighted in the heads.

Using free weights or weight training machines, while improving the muscles in general, does not necessarily improve the golfing muscles. It is important that the golfing muscles are developed with the correct balance. Otherwise a swing imbalance may result. It is impossible to replicate an individual's golf swing with free weights such as barbells or dumbbells or weight machines. There is no substitute for resistance weight training with a suitable heavy and adjustable weighted golf club to suit each individual.

The "Protator" training device is a short shafted weight training device which has a slight bend in the shaft, a fixed weight and a teaching grip. The weight or grip cannot be adjusted. The product is expensive and is difficult to be carried in a golf bag. It is too different from a conventional club and does not give the same feel. The weight is relatively light for the length of the shaft, although the shaft bend does add a moment which replicates the club head to some extent. Club face mid swing position alignment is marginally possible due to the shaft bend.

The "Swing Right" training aid is a straight, short shafted weight training aid with a training grip. It is not as expensive as the 'Protator' but is too different from a normal golf club. A heavy and a light weight are provided. It has a teaching grip which is too restrictive for use by the average-to-good golfer, and is difficult to carry in a golf bag to use for warming up with at the golf course. Club face mid position alignment is not possible.

The "Power Swing Fan" apparatus is a straight shafted device with large fan blades attached. As it is swung, the fans rotate to generate resistance. It is too dissimilar to a golf club feel and gives no mid swing position alignment. The fan is expensive, bulky, hard to store and requires a lot of room to swing.

Golf muscle training methods and apparatus are not new but nothing on the market fully addresses the needs of the golfer today to develop the golfing muscles.

SUMMARY OF THE INVENTION

The present invention provides a flexible, universal and portable weight training apparatus for developing and keeping in condition golf muscles, comprising a simple, quick and temporary clamping method to attach a weight apparatus to an existing golf club shaft with no damage to the club. The weight training apparatus can be easily positioned along the length of the shaft, at right angles and readily removed from the shaft. Individual extension weights can be added to the weight training apparatus. In accordance with the invention, there is provided a weight training apparatus for attachment to an elongated shaft, the weight training apparatus comprising a weight carrier including an elongated weight supporting portion having a longitudinal axis. A clamp mechanism cooperates with the weight carrier to clamp the weight carrier to the shaft with the axis of the weight supporting portion extending substantially perpendicular to a plane extending through the axis of the shaft. At least one weight is supported by the weight supporting portion with an axis of the weight extending substantially coaxial with the axis of the weight supporting portion. In one embodiment in which the shaft is that of a sports implement having a head portion, the weight is offset laterally with respect to an axis of the shaft and extends in overlying relation with the head portion of the implement. Moreover, one or more extension weights can be coupled to the shaft by the weight carrier. The weight supported by the weight supporting portion and/or the extension weights can extend in-line with or be off-set with respect to the shaft. Also, the weight can extend in-line with or be off-set with respect to the weight carrier. According to a further embodiment of the present invention, there is provided a golf muscle weight training apparatus, which has a pipe clamp type mechanism for coupling to an existing golf club shaft, wherein the apparatus can be positioned on the shaft anywhere between the head and the grip to adjust the leverage affect, wherein separate weights are positioned above the club head and can be attached and removed, and wherein the axis of the weights extend parallel to the leading edge of the club head.

DESCRIPTION OF THE DRAWINGS

A specific embodiment of the invention will now be described by way of example, with reference to the accompanying drawings in which.

DESCRIPTION OF PREFERRED EMBODIMENTS

Figure 1:
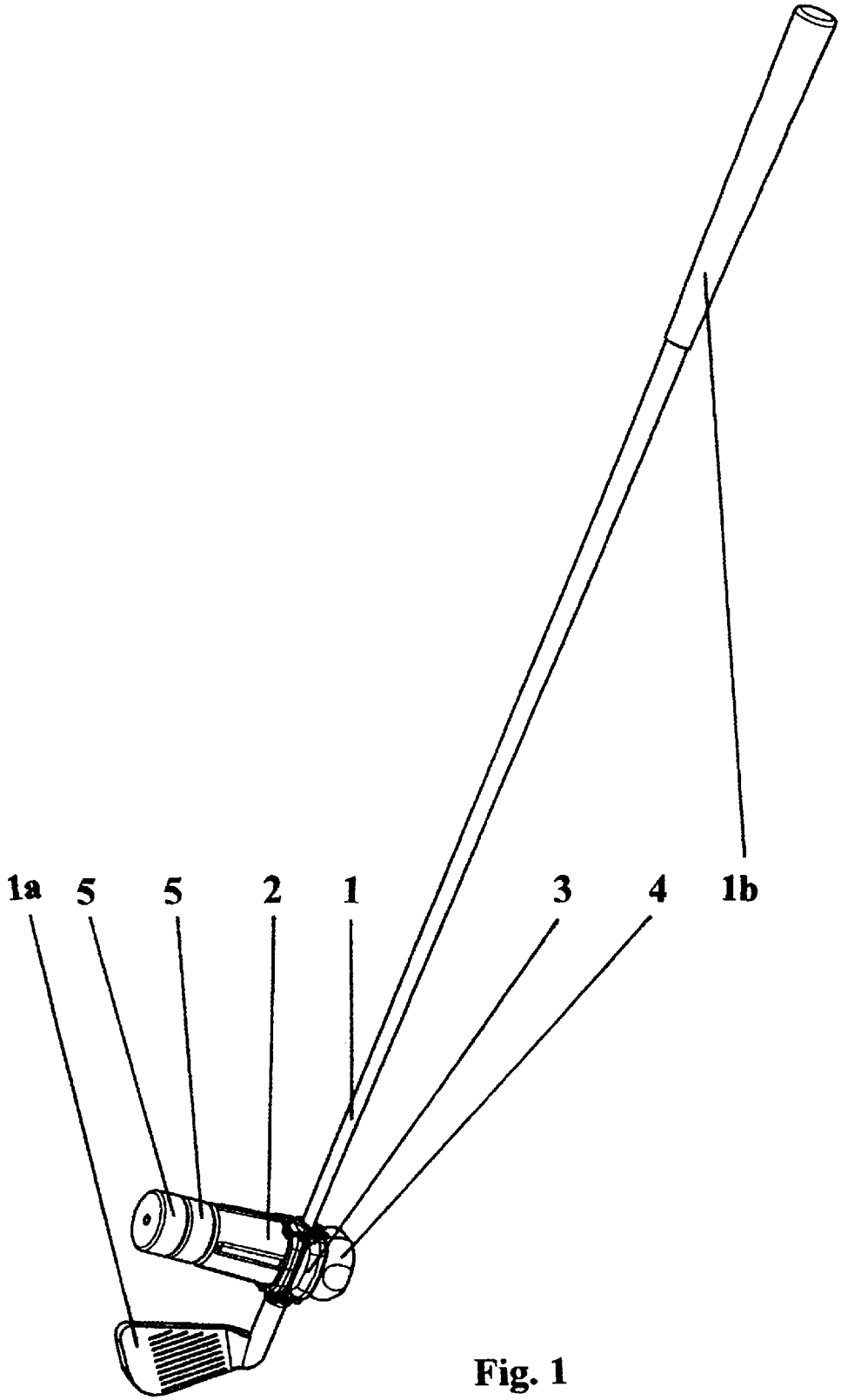
FIG. 1 shows an overall top front perspective view of the golf muscle weight training apparatus provided by the invention, which is clamped onto an existing golf club shaft 1, the apparatus being positioned adjacent the club head 1*a* at the maximum leverage position, and wherein two extension weights 5 are attached.

FIG. 1 shows an overall front perspective view of the golf muscle weight training apparatus which is clamped onto an existing golf club shaft. The apparatus is positioned adjacent the club head at the maximum leverage position. Two extension weights are attached.

The golf weight training apparatus includes [of] a main weighted front clamp 2 and a lighter rear clamp 3. The clamp halves are clamped together via a clamping mechanism, which partly consists of an adjustable hand knob and threaded shaft 4. Weight extensions 5 can be added to the front of the front clamp 2.

It is more difficult to clamp or attach a golf training weight to an iron or a wood club head, as all the heads are different designs, materials and are irregular shapes. It is much easier to clamp a weight apparatus to the shaft of the club, as it is a relatively consistent shape and are more easily clamped feature. In accordance with this invention, a shaft, or the shaft of a golf club is used as a weight carrier, in a similar manner where weights are added to a shaft to make up barbells and dumbbells. There are many possible methods of clamping or securing a weight to the club shaft. A quick self-contained method of clamping and removing a weight apparatus is preferable. Exercise time is at a premium and some people are not mechanically minded or dextrous, so a simple, easy to use, self-explanatory and quick universal system of clamping is preferable.

Using an existing golf club as the support structure for the weight training apparatus offers the advantages that golfers already have their clubs at hand, are familiar with them and costs are kept down in comparison to specialist weighted clubs. All that is required to temporally convert an existing golf club into a weight training tool, is the addition of the weight. training apparatus in accordance with the invention.

Although the golf club shown is an iron golf club, but the weight training apparatus can be attached to a wood, even a putter, or a shaft or a representation of a golf club. The further the weight training apparatus is positioned from the grip, the greater the leverage affect. The closer the weight is positioned to the grip end of the shaft, the less the force affect on the golfing muscles. At the maximum leverage position, that is, where the weight training apparatus is attached nearest the club head, the weight training apparatus gives the greatest force affect on the golf muscles when the golf club is swung and exercised. The golfer can regulate the affect the weight has on the golfing muscles simply by moving the weight apparatus up and down the golf shaft and by adding or removing weight extensions. Hence, if fight training is required in general, or for a particular set of exercises, the weight training apparatus can be positioned immediately below the grip or on the top half of the shaft. Conversely, if heavy. training is required, the weight training apparatus can be positioned adjacent the head or on the lower half of the shaft. The longer the club, the greater the leverage affect. The weight can be positioned at any position along the shaft between the grip and head to suit the individual golfer's strength and exercises being undertaken. More than one weight training apparatus can be clamped to the golf club shaft at any time and in any pattern as shown, for example, in FIG. 10. A first weight training apparatus 31 including front clamp 32, rear clamp 33 and extension weights 34, is clamped to the club shaft 1 near the club head and a second weight training apparatus 35 is clamped to the club shaft 1 at a point above the weight training apparatus 31. In one embodiment, the front and rear clamps are held together by suitable fasteners, such as by wing nuts 36 received on a threaded shaft. The rear weight clamp 33, or wing nut side, can include a slot at a radius about one of the wing nuts so that the rear weight clamp 33 can be pivoted open once the wing nuts have been backed off The front clamp 32 can include a shaft location groove 38 in its clamping surface and the mating clamping surface of the rotating rear weight clamp can be flat. However grips can be provided on the clamping surfaces of both weight clamps 32 and 33. In another embodiment, the front and rear clamps 32 and 33 can be similar to or identical with the front and rear clamps 2 and 3, and the extension weights 34 can be similar to or identical with the extension weights 5 and can be secured to the front clamp 32 in the manner to be described for extension weights 5.

The weight training apparatus together with the extension weights are compact and light enough to be carried in the golf bag or be stored conveniently at home ready for use. Prior to playing golf, it is important to warm up and stretch the golfing muscles. It is a simple and quick matter to remove the weight apparatus from the golf bag, attach it together with the optional extension weights 5 to the shaft 1 of a selected golf club and undertake some of the prescribed practice exercises, such as a half swinging back and fourth.

Figure 2:
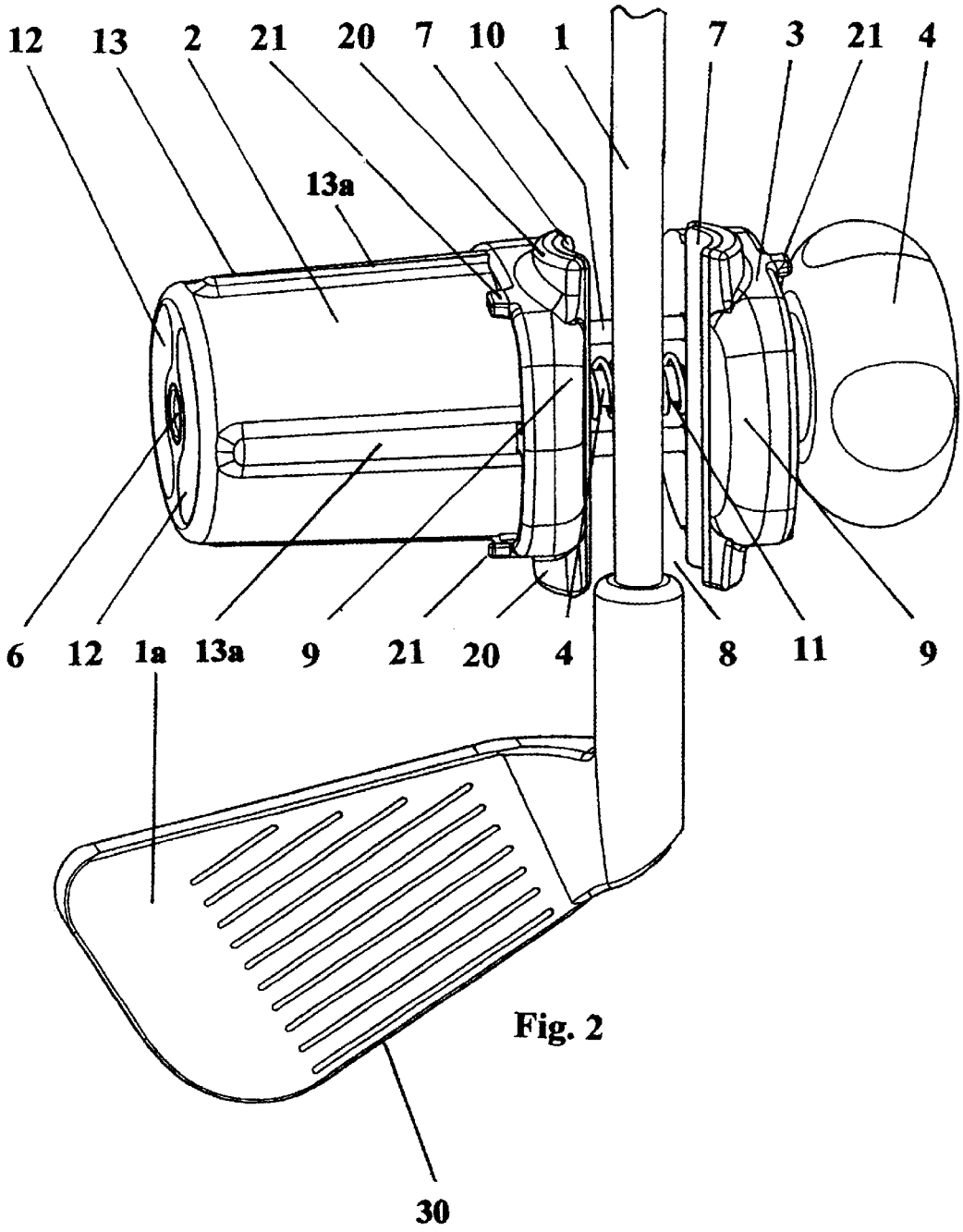
FIG. 2 shows an enlarged front perspective view of the weight training apparatus as per FIG. 1 but where it is in the open position, ready to accept a golf club shaft to be clamped in place, adjacent to the club head and no extension weights or safety band are shown.
Figure 4:
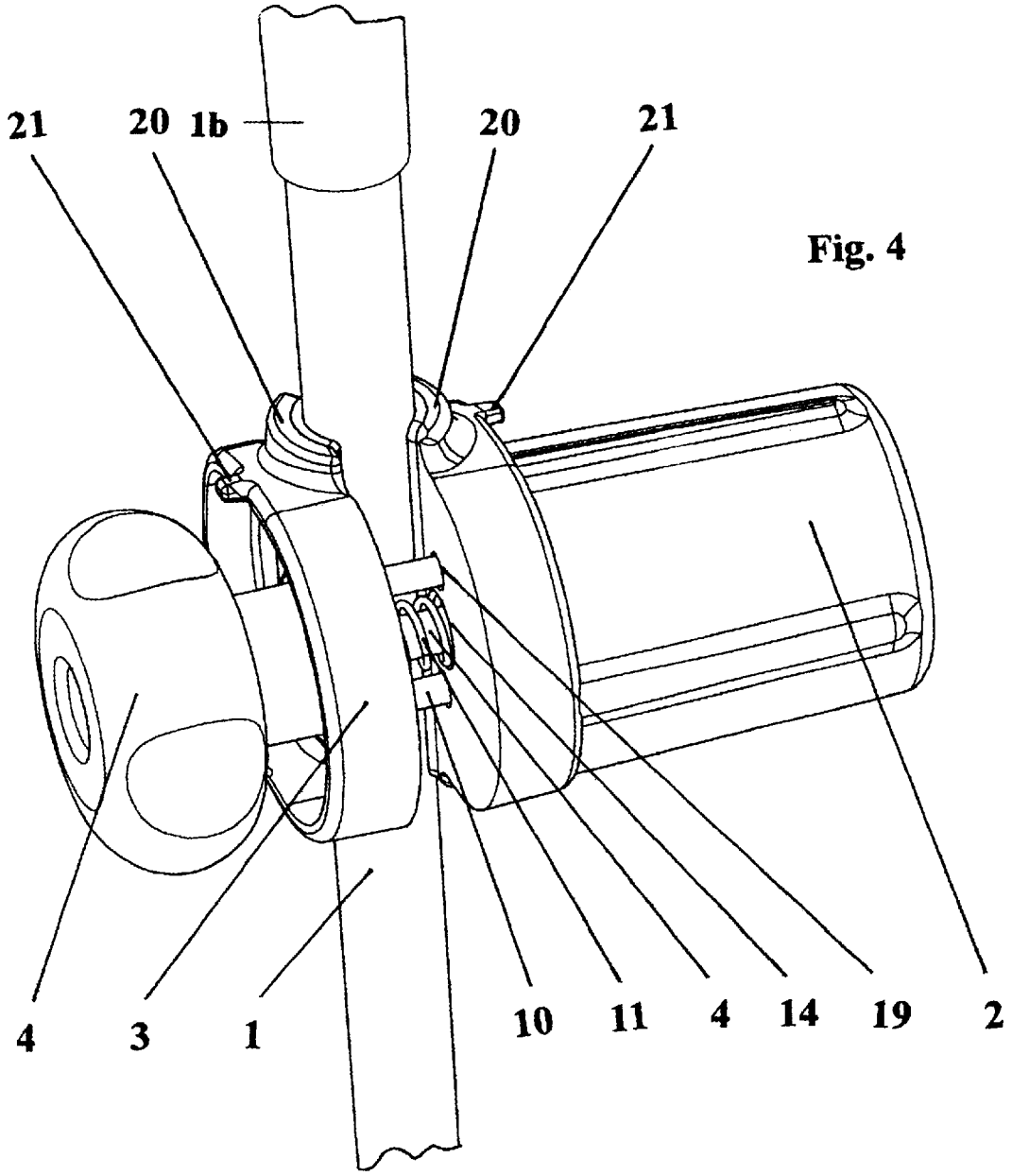
FIG. 4 shows enlarged rear perspective view of the weight training apparatus positioned below the golf club grip, no extension weights or safety bands are attached.
Figure 5:
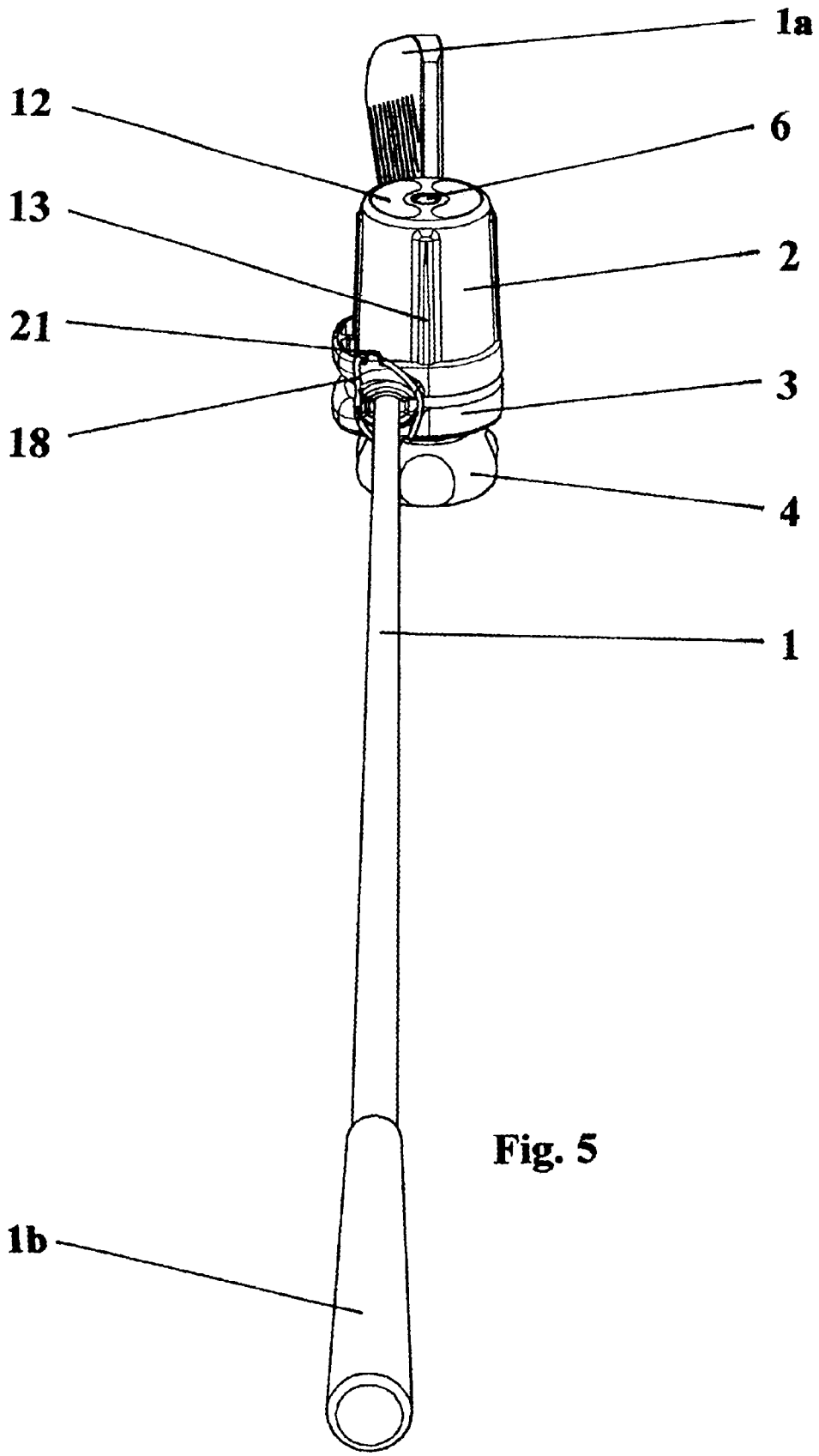
FIG. 5 shows an overall top, user's eye perspective view of the weight training apparatus clamped to the lower end of a golf club shaft, no extension weights are attached.

Referring to FIGS. 1, 2 and 5, the weight training apparatus is positioned above and extends generally parallel to the golf club head and is generally positioned above the centre of gravity of the club head. The axis of the main weight 15 is coaxial with the axes of the extension weights 5. Also, the axes of the front clamp 2 and the weights 15 and 5 are offset with respect to the shaft 1 of the golf club. This has the advantage that the weight apparatus mass is concentrated over the club head, in affect, the mass of the club head is being increased and the affect of hitting the ball is also being replicated, so that the appropriate golf muscles can be more readily developed. If, for example, the weight apparatus mass were concentrated around the axis of the shaft of the club and not above the club head, it would not be as advantageous, as the golfing muscles would not be as well developed. However, in accordance with a further embodiment shown in FIG. 11, the shape of the weight training apparatus can be, for example, a donut shape. In this further embodiment, the weight training apparatus includes a front clamp half 42 and a rear clamp half 43 held together by a threaded shaft portion of a handle 44 (which can correspond to handle 4 in FIG. 7), sandwiching or clamping the golf club shaft 1 in-between, with the shaft located in shaft location grooves 46 which can include shaft grips 47 similar to shaft grips 7. The clamp halves 42 and 43 define a lead-in or side entry 48 for the club shaft 1. The securing handle 44 is located at the opposite side. Extension weights 45 and 45a can be supported by the front clamp half 42 and positioned parallel to and extending in overlying relation with the club head. Extension weight 45 can be secured to the clamp halve 42 and extension weight 45*a* can be secured to extension weight 45. The axes of the extension weights 45 and 45*a* are coaxial and can extend substantially perpendicular to the axis of the club shaft 1. However, the axes can be offset relative to the axis of the club shaft 1 in the manner of the weight training apparatus shown in FIGS. 1–8. The axis of the clamp formed by clamp halves 42 and 43 is in-line, i. e., coaxial, with the axis of the shaft. The axis of the handle 44 is offset laterally with respect to the axis of the club shaft 1. The weight training apparatus can include a bias structure (not shown), such a bias spring 11 shown in FIG. 7, and one or more anti-rotation pins (not shown) similar to pins [7] 10 shown in FIG. 7, for example. By virtue of the clamping mechanism, i.e., the hand knob with its threaded shaft, the spring, and the anti-rotation pins, the front and rear clamps 42 and 43 generally open and close parallel to one another. The spring can be located on the anti-rotation pin as well as or instead of the threaded shaft. The anti-rotation pin can be located above the threaded shaft to the side, or can extend diagonally. A rubber type bellows can be placed over the spring or pin. A bush can be used to locate the clearance portion of the anti-rotation pin. Although the clamp halves 42 and 43 are shown to be generally donut-shaped, this clamping arrangement, with the in-line orientation between the axis of the weight carrier and extension weights can also be used for the weight training apparatus shown in FIGS. 1–8.

Referring to FIGS. 1–6, to use the weight training apparatus indoors, a short club, such as a pitching wedge, would be the most likely choice, as it has a relatively small swing arc. One can get the same leverage affect by using a longer club, such as a driver or longer iron with a donut shaped weight attached and use extension weights. But the advantage of a full overhanging weight training apparatus is that the mass is concentrated in the area required, above the club head, so for any given length of club the leverage affect is maximised.

The weight apparatus, by virtue of the clamping mechanism, can accommodate different diameter golf shafts of different material, tapers and steps and can be positioned at any position along the length of a golf club shaft between the club head and the grip.

For the stronger golfer, and for certain exercises, extension weights 5 can be attached to the front clamp 2. This increases the mass of the weight apparatus and moves its centre of gravity further out over the club head, which increases the leverage affect. This gives a further affect of exaggerating or increasing the mass of the club head and the affect of hitting the ball and hence making the golfing muscles work harder for any given exercise.

The combination of positioning the weight along the length of any golf club shaft between the club head and grip and the addition of one or more extension weights, offers the golfer flexibility to suit individual training needs, tailored to strength level and the exercise being undertaken for golf muscle development.

FIG. 2 shows an enlarged top front perspective view of the weight apparatus as per FIG. 1, but wherein it is in the open position, ready to accept a golf club shaft to be clamped in place, adjacent to the club head. No extension weights or safety bands are shown.

Figure 7:
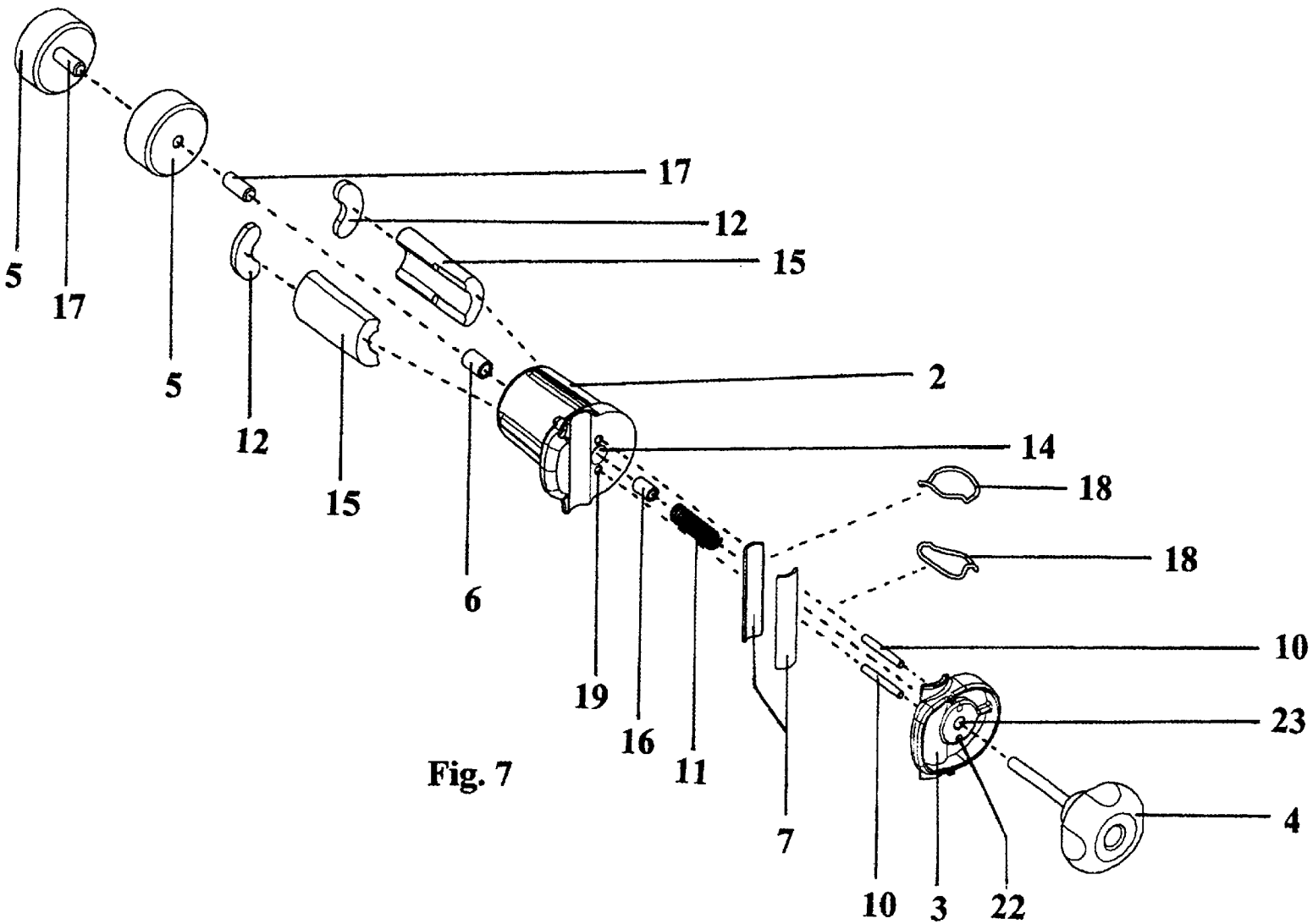
FIG. 7 shows a rear-to-front exploded perspective view of the golf muscle weight training apparatus, the golf club not being shown.

FIG. 7 shows a rear-to-front exploded perspective view of the golf muscle weight training apparatus, without the golf club shown. The items of the apparatus include, in order from the bottom right to the top left of the page: a hand knob threaded shaft 4, rear clamp 3 (with a through hole 22 and pin location holes 23), anti rotation pins 10, safety bands 18, shaft location grips 7, spring 11, rear thread insert 16 for the hand knob threaded shaft, front clamp 2 (with pin clearance holes 19 and spring pocket 14), front thread insert 6 for the extension weight stud, left and right weight material 15, left and right hand weight retainers 12, extension weight studs 17 and extension weights 5.

The front clamp half 2 has four main purposes: to act as half of a mating clamp to accept a golf club shaft 1, to contain the main weight 15; to provide a front thread fixing 6 for front extension weights 5; and to contain the front part of the clamping mechanism—which includes a rear internal thread fixing 16 for the hand knob 4, a spring pocket 14 and clearance holes for the anti-rotation pins [ 19] 10. The rear clamp half 3 has two main purposes: to act as half a mating clamp to accept a club shaft 1 and to contain the rear part of the clamping mechanism—which includes containing the hand knob 4 and the two anti rotation pins 10. The front clamp half 2 and the rear clamp half 3 also include tabs 21 to facilitate the application of the bands 18.

The golf club shaft 1 is located in semi-circular location grips 7, which run the depth of the front and rear clamp halves. The shaft location grooves provide an under cut or scollop to help retain the shaft 1 in place once it is clamped. The two clamp halves are held together with the threaded shaft of the hand knob 4 combination and clamp or sandwich the golf club shaft in between. The vertical axis of the golf club shaft 1 and the horizontal axis of the hand knob 4 are off-set relative to each other. This allows the weight of the apparatus to be positioned more over the club head, as the head is off set to the rear side from the golf shaft.

For the weight apparatus to be positioned correctly, the gap between the front 2 and rear 3 clamp halves is positioned at right angles to the leading edge of the club head and where the body of the front clamp is in line with the club head. The gap includes an open access side 8, where the golf club shaft is entered into and removed from the apparatus, shaft location grips 7 for the club shaft and the mechanism side, where the clamping and anti-rotation components are located. The open side has symmetrical edges which have radii or [lead-ins] lean-in 9 forming a side entry to allow for a guiding or funneling action of the shaft into the front and rear location grip grooves 7. The mechanism side consists of the threaded shaft of the hand knob 4, two anti-rotation dowels or pins 10 and the spring 11.

The front clamp 2 has a main cylindrical body and an integrated clamping feature which contains the grip 7 and provides a lead in extension 9 for the shaft. The clamp halves are of one piece [constriction] construction with stepped through bores on the weight and hand knob clamp axis. The cylindrical body contains two. cavities to hold the weight material Alternatively a separate cylindrical external weight could be used. Weight ballast material such as lead shot, concrete, sand or the like can be used in the cavity and be held or encapsulated in place with a one or two piece front cover 12 or the weight could be bonded in place.

The two front cavities are separated with a vertical web, this web is in line with the two anti-rotation pin clearance holes 19 and are supported by this web. The lead in area is strengthened with a return. The advantage of having cavities for the weight material is that standard material, such as lead shot, can be used and poured in. Otherwise a separate component may have to be manufactured. In addition, the front clamp looks aesthetically pleasing and smooth, being made in one piece, and the weight is effectively hidden from view.

The rear clamp 3 contains one of the grips 7, defines a lead in extension 9 for the shaft, provides holes for receiving the dowels or anti-rotation pins 10 with an interference fit, has a flat [for] surface adjacent the hand knob 4 and clearance for the threaded shaft. The clamp 3 is a one-piece construction with an outside wall or return to add strength.

The profiles for the front and rear clamp are the same. The mechanism side has a radius to match the hand knob. The open lead-in side 8 is rectangular with radiuses, and projects out past the location grips 7 and the hand knob, forming a generally 'D' shape.

The front and rear clamps can each be injection moulded from plastic in one piece, in a simple open and shut mould tool. The part design has the appropriate webs and tapers to suit the manufacturing process. Alternatively, the clamp can be cast, fabricated or machined from any material type. The use of plastic material for the clamps gives the product a softer warmer feel and limits damage if the apparatus is dropped. The plastic also allows for ease of coloring, suitable surface finish and molded in lettering.

The front and rear clamps have a small symmetrical extensions 20 (FIG. 2) located above the shaft location grips 7, which project above the top and bottom of the clamps. This increases the length of the shaft location grips 7 and aids the visual location of the golf shaft into the clamp apparatus. The grips 7 are made from rubber or other suitable resilient material and protect the steel or graphite shaft from damage. The resilience of the material aids the gripping action. The front and rear grips are identical and are bonded or pressed in to place. The grips 7 can be one or two pieces.

The front and rear clamps 2 and 3 open and close generally parallel to each other. The movement to take up the taper and steps on the golf shafts is accommodated by the rubber type grips and the clearance allowed for on the hand knob shaft in the rear clamp and on the anti-rotation pins in the front clamp.

Figure 6:
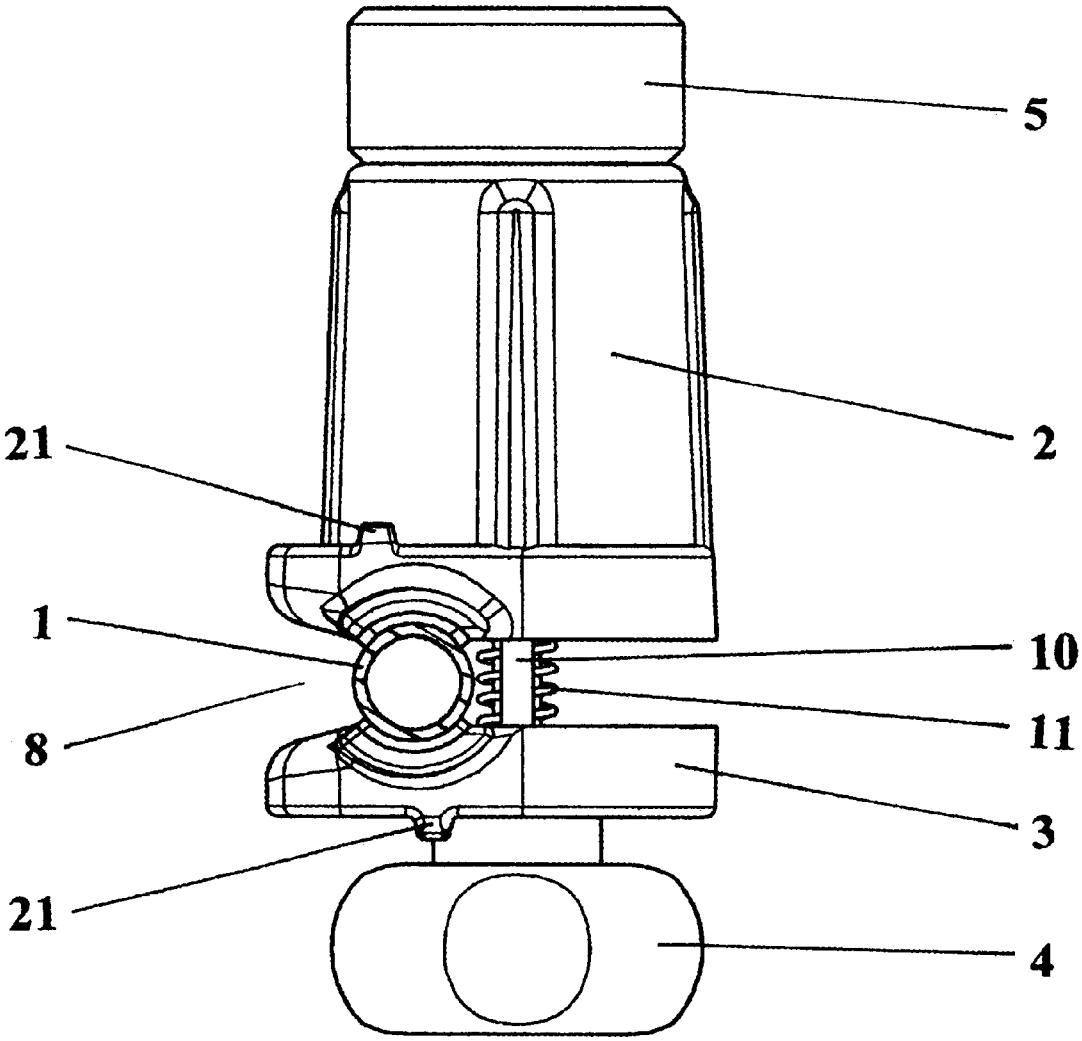
FIG. 6 shows a plan view of the weight training apparatus clamping the equivalent of the maximum diameter shaft, no club head is shown and one extension weight is attached.

Referring to FIGS. 2 and 6, a threaded insert 6, is shown centrally positioned on the front clamp half 2 clamping axis and accepts the stud 17 of the first extension weight 5. The outer surface of the extension weights 5 can include indentations to facilitate gripping of the weights while the weights are being attached to the front clamp.

In operation, the golf muscle training device is positioned on the shaft so that the clamping and weight axis is aligned parallel to the leading edge of the golf club head. To aid alignment and handling, spaced equally radially apart on the cylinder body of the front clamp 2 are four length-way protrusions 13. As shown in FIG. 2, the top and bottom protrusions have a coloured line or strip 13*a* to match right or left hand orientation and to assist in lining up square to the leading edge of the club face above the club head. For left hand use, the training apparatus can be used upside down or rotated 180 degrees about the clamp and weight axis.

As the hand knob 4 is rotated, the two clamp halves are drawn together, generally parallel to each other, to firmly clamp the shaft [I] d into the shaft location grips 7. The weight apparatus is opened by rotating the hand knob 4 in the opposite direction.

This method of clamping requires the faces of the shaft location grips 7 to be opened only slightly more than the diameter of the shaft, the shaft can then be moved out sideways from the apparatus through the open side or side entry 8. This ensures that it is very quick and safe to clamp and unclamp the apparatus and allows golfers with weaker hand strength to operate the device.

If, for example, a set of exercises were complete wherein the weight apparatus was attached to the golf shaft below the grip, and, the following exercise required the weight to be moved down the shaft for a greater leverage affect, the weight only need be slightly unclamped by turning the hand knob 4, then slid the down the shaft and reclamping by turning the knob 4 in the opposite direction. The weight does not have to be removed from the shaft to be repositioned along the shaft. Little time is lost to reposition the weight, allowing the user to concentrate on the training in hand.

Figure 3:
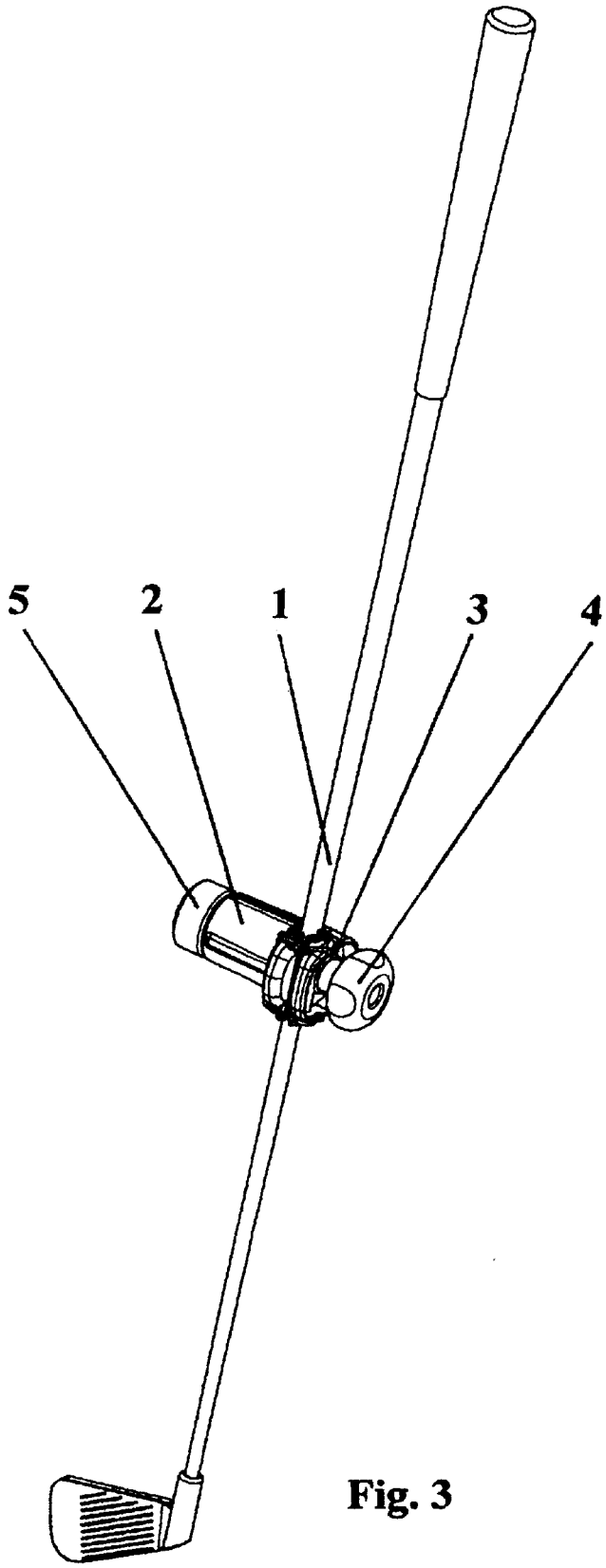
FIG. 3 shows an overall front perspective view of the weight training apparatus as in FIG. 1, shown positioned half way up the golf club shaft, and wherein one extension weight is attached.

FIG. 3 shows an overall top front perspective view of the weight apparatus as in FIG. 1 but where it is positioned half way up a golf club shaft and one extension weight is added. Having the golf muscle weight training apparatus positioned half way up the shaft reduces the leverage affect on the golfing muscles. Being able to move the weight apparatus up and down the club shaft gives the user the flexibility of adjusting the leverage affect instead of adding or removing weight extensions or using longer or shorter clubs. By having the weight apparatus positioned further up the golf club shaft better visibility of the club head is also achieved, should that be required for any exercises.

The shafts of golf clubs are generally tapered inward from the grip down to the club head. Different makes of golf clubs have different-shaft diameters, tapers and steps. Some shafts have smooth tapers while others have combinations of parallel lengths and steps. The two clamp halves are designed to be free floating enough to accommodate all types of shafts and can also be clamped to a shaft on top of a shaft step. The weight apparatus is universal fitting. It can be repeatedly and firmly attached to all steel or carbon fibre (graphite) club shafts and does not damage or leave any markings on the shaft.

Each overhanging extension weight 5, which in this case is round, has a central through thread with a half inserted stud 17 fixed in one end. The first extension weight is screwed into a thread 6 in the front clamp 2 and a second extension weight can be screwed into the first, and so on. The extension weights lie on the same axis as the apparatus weight and clamping axis and mate with the cylindrical body of the front clamp. The extension weight axis is parallel to the leading edge of the club face and is located above the club head. The extension weights 5 are identical and as many as required can be attached. In one embodiment, the extension weights match the size of the barrel of the front clamp, but any size and shape is possible. The method of attachment is quick, simple and safe. The extension weights can be made from lead, cast iron or steel and be plastic covered or a plastic/sand combination. In this case, the weights are positioned end on end where the less the number of weights, the greater the view of the club head.

FIG. 4 shows an enlarged top rear perspective view of the weight apparatus, positioned below the golf club grip 1*b*. No extension weights or safety bands are attached.

This top position of the weight apparatus reduces the leverage affect of the golfing muscles to the minimum amount, so that the club is relatively easy to swing. This position may suit beginners and some lady golfers. Once the golfing muscles start to increase in strength and suppleness, the weight apparatus can be moved down the shaft to suit the individual requirement and extension weights can be added.

The axis of the golf club shaft 1 is oriented generally vertically and the clamp halves are oriented, and move in and out, generally at right angles to the shaft axis. The clamping axis, that is, the axis of the hand knob 4, is oriented generally horizontally, at right angles to the shaft axis. The axis of the weight in the front clamp 2 and weight extensions are coincident with the axis of the hand knob 4, or clamping mechanism, but could be offset with respect to one other.

The clamping and anti-rotation system are very compact. The mass of the front clamp is positioned generally parallel to and above the 'sweet spot' or the centre of gravity of the club head, hence giving a realistic training aid.

To aid the speed of use of the apparatus, a spring 11 is placed between the front 2 and the rear 3 clamp halves. This ensures that the weight halves are always forced apart against the position of the hand knob threaded shaft 4 to allow ease of entry of the golf shaft 1 into the clamp jaws 7. In this embodiment for compactness, the spring 11 is placed over the shaft of the hand knob 4 or clamp axis. This also has the advantage of central loading between the clamp halves. The spring 11 also acts as protection for the golf shaft 1 against the thread of the hand knob 4. Alternately, the spring or springs could be placed over, for example, the anti-rotation pins. A pocket 14 for the spring 11 is provided in the front weight half 2. An optional protective tube or bellows could be placed over the spring, or thread, to further protect the club.

To stop the clamp halves from rotating relative to each other about the axis of the hand knob 4, the apparatus includes an anti-rotation system. In this embodiment, two pins or dowels 10 are used, each pin 10 is fixed in the rear clamp half 3 and a suitable sliding clearance fit is provided in location holes 19 in the front clamp half 2. One pin is positioned above the clamp axis or spring and one pin is positioned below the clamp axis. The anti-rotation apparatus is accommodated on the mechanism side of the clamp. Alternatively a single anti-rotation pin could be positioned to one side of the spring.

The pins 10 are long enough to be engaged with the front clamp half 2 at the maximum opening of the clamp halves. The largest opening of the clamp has to fit the maximum diameter shaft, as measured immediately below the grip, plus clearance. The smallest shaft the weight training apparatus has to accommodate is the minimum shaft diameter, as measured immediately above the club head. The hand knob 4 and thread, the spring 11 and the anti-rotation pins 10 form a very compact and efficient system of clamping.

FIG. 5 shows an overall top, user's eye perspective view of the weight training apparatus clamped onto the lower end of a golf club shaft. No extension weights are attached.

A critical intermediate position of the first part of the golf swing is when the club is in the middle of the back swing position, where the club is parallel to the ground, in [fine] line with the target and the leading edge of the club head should generally point vertically. This requires a critical hinging of the wrists, as the shoulders pivot around the body. It is this ideal position where the club face is in a neutral position and aligned on plane that most golfers want to achieve for every swing. This position needs to be replicated for certain weight training exercises, hence requiring a relatively clear view of the club face or use of other alignment methods at the half swing phase. The weight training apparatus is a compromise on size, mass and the view that the user has of the club head. Having extension weights, which are removable, provides a clear view of the club face at the address position.

With no weight extensions attached, the user can view the head of the club, but when two or more extensions are added, although little of the club head 1*a* is viewable, the top alignment line 13 on the body of the front clamp 2 can be used as the centre position of the club head and the left hand edge of the body of the front clamp corresponds to the position of the leading edge of the club head. As the club is swung, an increased view of the club-head is gained, so that even if the head is obscured at the address position and extension weights are added, at the middle of the back swing position, all of the club head is in view.

As a safety feature, top and bottom bands 18 can be hooked on to secure the front and rear clamp halves together. Thus, if for any reason the pressure clamping the apparatus to the club shaft releases, a back up securing feature is provided. The purpose of the safety measure is to hold for a short period only to give the user a safety margin to identify any problems and halt the exercises safely.

Local tabs 21 protrude from (or slots can be formed in) the returned outward edges adjacent the shaft location groove 7, on the top and bottom of the front 2 and rear 3 clamp halves as shown in FIG. 4. One or more suitable straps or bands can be used to supplement the threaded hand knob 4 in keeping the front and rear clamp halves together. For example, in one embodiment, hook and loop strap-type fasteners can encircle the front and rear clamp halves, and preferably the straps pass through slots in the front and rear clamp halves. In another embodiment, the tabs 21 act as hooks so that, for example, a sturdy rubber band 18, or such, can be stretched out between the matching rear and front hooks 21.

FIG. 6 shows an enlarged plan view of the weight apparatus, clamping the equivalent of the maximum diameter shaft. No club head is shown and one extension weight is attached. The maximum diameter club shaft 1 is fully contained within the shaft location semi-circle grooves of the grip 7, where the radius of the largest section of the shaft matches the radius of the grips. When the clamp is opened up to its maximum position, by rotating the hand knob 4, clearance is provided between the shaft and, each grip 7. Clearance is provided between the spring and the golf club shaft. The end of the second extension weight is about level with the end of the club head but any number of extension weights can be added to extend past the end of the club. The extension weights can be of any shape and diameter.

Referring to FIG. 7, the apparatus has a minimum number of parts, uses a maximum number of off-the-shelf standard items, is simple, portable, compact, relatively easy to manufacture and assemble and hence cost affective for the features that it offers. For the assembly of the apparatus, the grips 7 are bonded to the shaft location grooves of the front and rear clamps. The anti-rotation pins 10 are pressed into the holes 23 in the rear clamp 3. The front 6 and rear 16 thread inserts are positioned in the front clamp 2. The weight material 15 is poured into or positioned in the cavities of the front clamp 2 and contained therein with caps or bonding material 12. The spring 11 is positioned in the pocket 14 of the front clamp 2. The rear clamp 3 is assembled to the front clamp 4 by extending the anti-rotations pins 10 into the clearance holes 19, extending the hand knob threaded shaft 4 into the clearance hole 22 and rotating the hand knob so that it engages the thread of the rear thread insert 16. The stud 17 is screwed into and bonded with the extension weight 5 where it can then be screwed into the front thread insert 6 in the front clamp 2.

Figure 8:
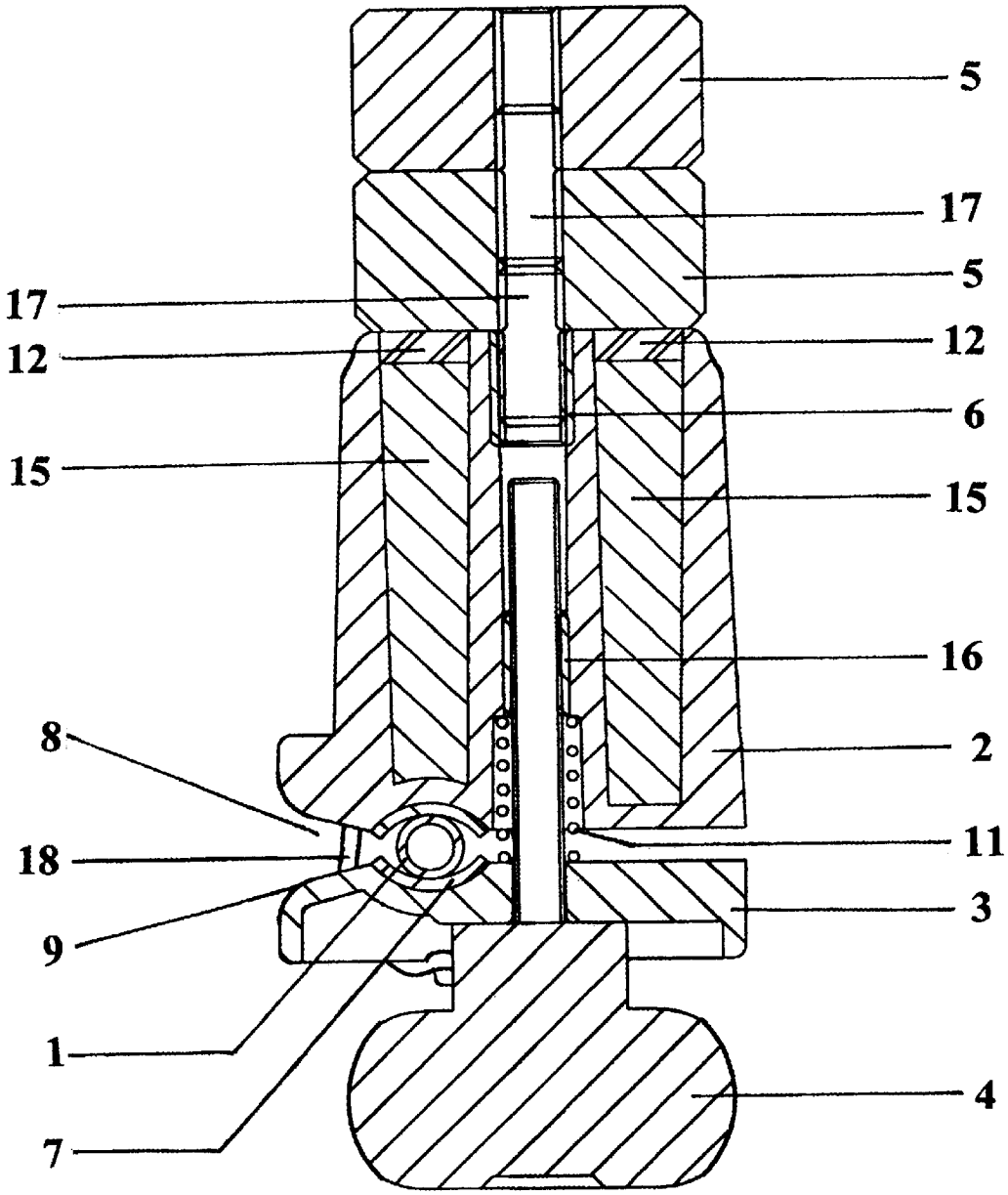
FIG. 8 is a sectional plan view of the assembled weight training apparatus, as per FIG. 1, clamping the equivalent of a minimum diameter club shaft. The section is cut through at right angles to the axis of the club shaft, through the axis of the clamping mechanism and weight mass. Two weight extensions are attached.

FIG. 8 is a close up sectional plan view of the assembled weight training apparatus, as per FIG. 1, clamping the equivalent of a minimum diameter club shaft. The section is cut through at right angles to the axis of the club shaft, through the axis of the clamping mechanism and weight mass. Two weight extensions are attached.

The hand knob threaded shaft 4 passes through the rear thread insert 16 into the central bore cavity arrangement. The front and rear clamps bottom out prior to the end of the hand knob 4 thread shaft hitting the stud 17.

Clearance between the two grips 7 ensures that the full clamping force of the hand knob threaded shaft 4 secures the golf club 1 shaft firmly in place. The radius of the shaft location grooves 7 equals the radius of the largest golf club shaft section to be clamped. The depth that the radius is positioned in from the mating faces of the clamp halves is less than the radius of the minimum shaft section to be accommodated. Hence, there is an under cut or semi-circle overlap which helps secure the club shaft into place and is relatively forgiving as to the exact position in which the club shaft can be within the shaft location grooves 7. Alternately, a [vee-shape] V-shaped groove can be used instead of the semi-circle was groove 7. To aid the clamping of the apparatus to the shaft, the ratio of the overall length of the grips 7 is greater than the diameter of the golf club shaft.

A retainer or stop, not shown, can be provided at the end of the threaded shaft of the hand knob 4 to ensure that the two clamps cannot come apart. The stop limits the opening of the clamps and hits against a shoulder or the threaded insert 16 for the hand knob 4. The stop can take the form of a nut, a [circlip] clip or other form of stop.

Figure 9:
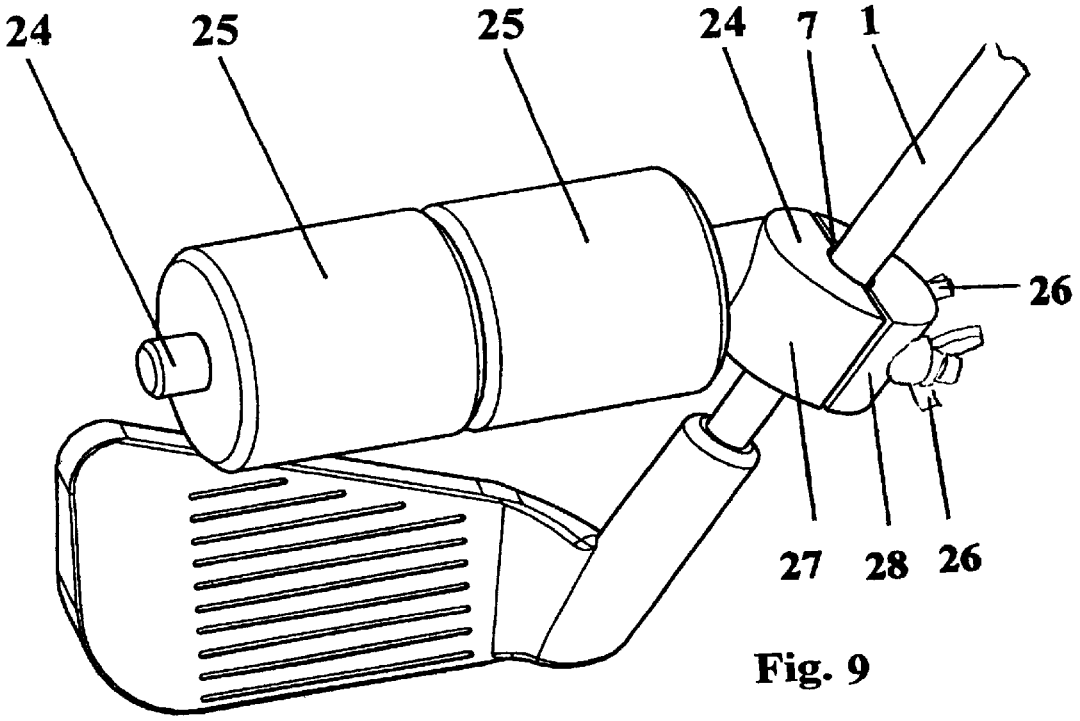
FIG. 9 shows an enlarged front perspective view of a further embodiment of a weight training apparatus provided by the invention.
Figure 10:
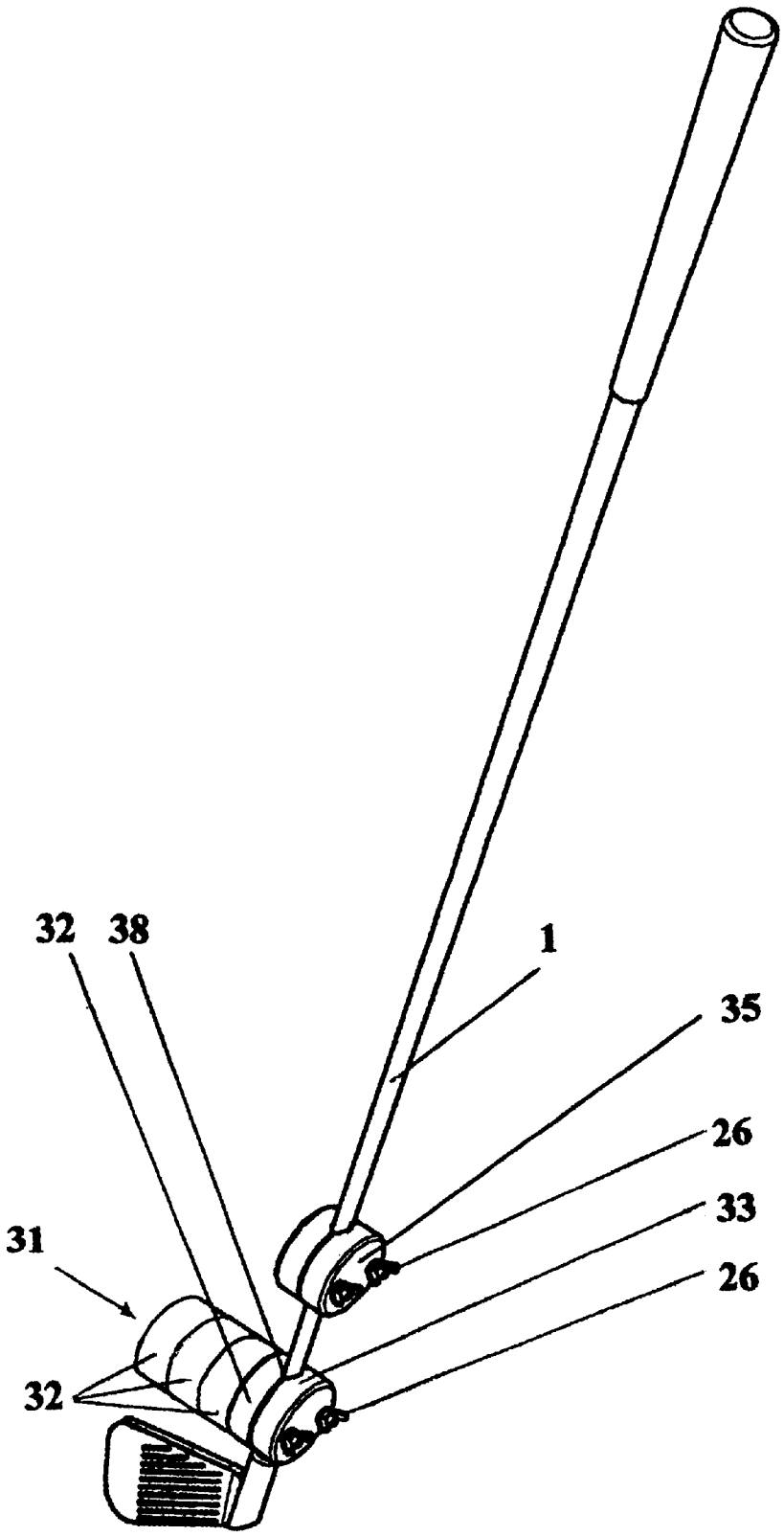
FIG. 10 shows a front perspective view of a further embodiment of a weight training apparatus provided by the invention in which more than one weight carriers are clamped to a golf club shaft.
Figure 11:
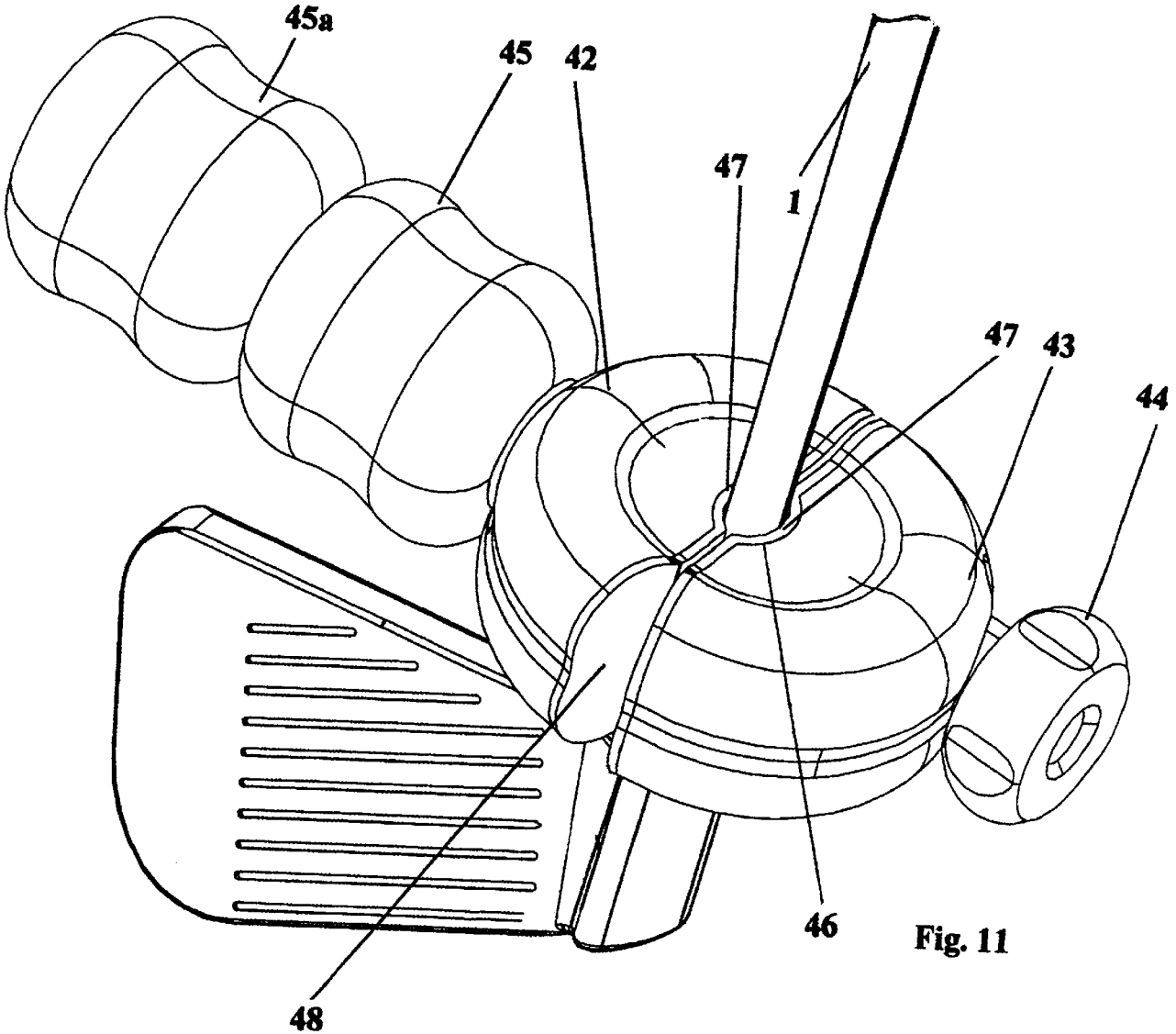
FIG. 11 shows an enlarged perspective view of a further embodiment of a weight training apparatus provided by the invention in which the weights extend perpendicular to the axis of the golf club shaft.

FIG. 9 shows an enlarged, front perspective view of a further embodiment of the golf muscle weight training apparatus. In this golf weight training apparatus, a weight carrier clamp 24 is attached to a golf club shaft 1 with a simple two-piece split collar pipe clamp arrangement including. clamp halves 27 and 28, with rubber grips similar to grips 7 (FIG. 7). A stud is used on each side of the golf club shaft 1 with wing nuts 26 or screws. The apparatus can be attached anywhere along the golf club shaft 1 between the club head and the grip to give a variable leverage affect. In this case, two separate external identical cylindrical weights 25 are assembled on the carrier shaft 24' via threads. Alternately, a lock nut or a clamp can be used. One, two or more weights 25 can be attached depending on the requirement of the user. A shoulder is provided on the carrier shaft to locate the first weight. Any number of weights can be added and the weights can be of any diameter or shape. Additional weights can be slipped over the first set of weights and located with [grub] screws. The axis of the carrier shaft 24' is aligned parallel to the leading edge of the club head or parallel to the ground and positioned generally above the center of gravity or sweet spot of the club head. The weight of the carrier 24 is offset to the one side of the golf club shaft. The axes of the extension weights 25 are also off-set relative to the golf club shaft. In this setup, the carrier shaft 24' extends at greater than ninety degrees with respect to the axis of the golf club shaft. This has the advantage that the mass of the weight apparatus is immediately above the club head and forms an extension of the club head. In a further embodiment, the carrier shaft can be adjustable so the angle relative to the club shaft can be adjustable to suit all clubs. This can be achieved by a simple clamp arrangement. The carrier shaft and clamp can be made from plastic or metal and the weights can be made from lead or metal. There are many variations of this arrangement, one being wherein the separate weights attach to each other so the weight carrier shaft 24' is eliminated. The split clamping arrangement can be the same diameter as the weights 25 to make the angle from the shaft axis parallel to the leading edge of the club head can be at the intersection of the front of the clamp to the rear of the first weight. This is a simpler system than that described previously. Any combination of the two systems and the embodiments of the weight training apparatus shown in FIGS. 10–12 is possible, including the adaptation of the donut-shaped or U-shaped weight located around the axis of the golf shaft with optional additional extension weights.

Figure 12:
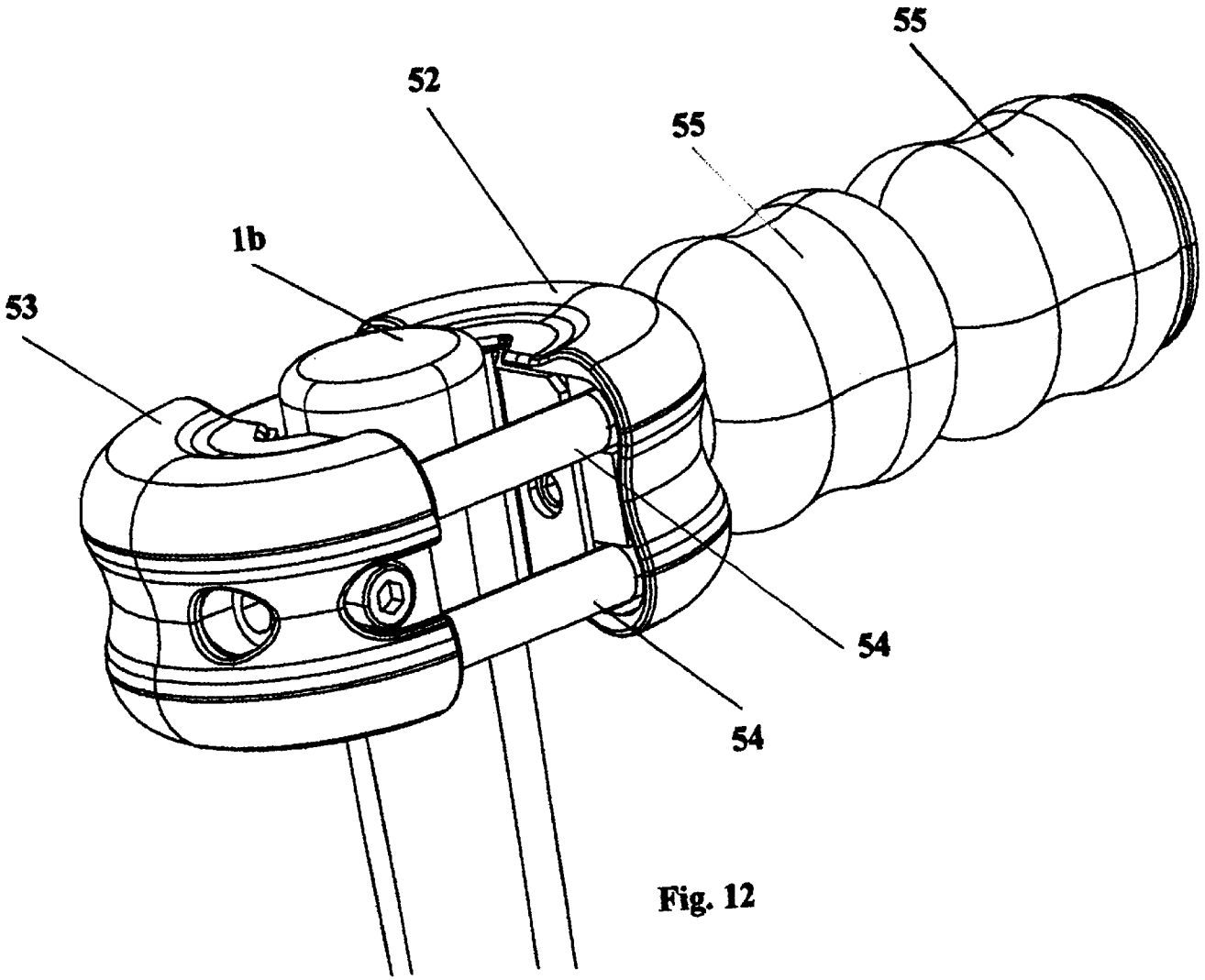
FIG. 12 shows an enlarged perspective view of a further embodiment of a weight training apparatus provided by the invention which is adapted to be slid over the hand grip portion of the golf club in mounting the weight training apparatus on the golf club.

Referring to FIG. 12, in another embodiment of the weight training apparatus, the clamp halves 52 and 53 are coupled together by springs 54 and movable away from one another to "open" the apparatus, providing a "top entry" type of clamping arrangement. This allows the weight training apparatus, after it has been opened up as shown in FIG. 12, to be slipped onto the club shaft 1 over the shaft grip portion 1*b* of the golf club, and to be slid down over the shaft grip and then slid along the club shaft into position near the club head (not shown) where the clamp halves 52 and 53 are secured together by tightening suitable hardware, such as bolts, wing nuts, or by anti-rotation pins, or the like. In this embodiment, the axis of the clamp formed by clamp halves 52 and 53 is substantially coaxial with the axis of the golf club shaft, and the axes of the extension weights 55 extend substantially normal with the axis of the golf club shaft.

It is the aim of this invention that the simplicity of the golf club weight training system will encourage golf muscle development on a regular basis for all levels of golfers, using a defined set of exercises which the golfer can tailor to his own needs. The apparatus is compact and portable, is easy to attach to the golf shaft, anywhere along its length, and makes simple adding and removing extension weights. This invention is shown by way of example only and any combination of features is possible.

What is claimed is:

1. A weight training apparatus for attachment to an elongated shaft of a sports implement, the weight training apparatus comprising:

a weight carrier including a weight supporting portion;

a clamp mechanism including a clamp member cooperating with the weight carrier to define an opening for receiving the shaft, the clamp mechanism including at least one securing member for securing the clamp member to the weight carrier, the securing member including a shaft received by the weight carrier and cooperating with the weight carrier and the clamp member to removably secure the clamp member to the weight carrier;

at least one weight supported by the weight supporting portion; and a bias spring located between opposing surfaces of the weight carrier and the clamp member, urging apart the weight carrier and the clamping member when the securing member is moved toward a release position.

2. The weight training apparatus according to claim 1, including a further weight supported by one of the weight supporting portion and the at least one weight.

3. The weight training apparatus according to claim 1, wherein the weight supporting portion comprises a support shaft, the at least one weight being supported on the support shaft.

4. The weight training apparatus according to claim 1, wherein the weight supporting portion includes a cavity for containing the at least one weight.

5. The weight training apparatus according to claim 4, wherein the at least one weight comprises weight ballast material filling the cavity.

6. The weight training apparatus according to claim 1, wherein one of the weight supporting portion and the at least one weight includes a threaded shaft and the other one of the weight supporting portion and the at least one weight includes a threaded opening for receiving the threaded shaft for coupling the at least one weight to the weight supporting portion.

7. The weight training apparatus according to claim 1, including an extension weight, adapted to be coupled to the weight supporting portion.

8. The weight training apparatus according to claim 1, wherein at least one of the weight supporting portion and the clamp member defines a lead-in portion for guiding the shaft into the opening during attachment of the weight training apparatus to the shaft.

9. The weight training apparatus according to claim 1, further including at least one anti-rotation member extending between the weight carrier and the clamp member for preventing relative rotation between the weight carrier and the clamp member.

10. The weight training apparatus according to claim 1, wherein the weight carrier includes a body portion that is generally cylindrical in shape.

11. The weight training apparatus according to claim 1, and including at least one extension weight coupled to the body portion and projecting outwardly therefrom.

12. The weight training apparatus according to claim 1, wherein the body portion includes at least one cavity for containing the at least one weight.

13. The weight training apparatus according to claim 1, wherein the bias structure includes a spring interposed between the weight carrier and the clamp member.

14. The weight training apparatus according to claim 1, wherein the weight carrier further includes a clamping portion having a first clamping surface, the clamp member having a second clamping surface opposing the first clamping surface and cooperating with the first clamping surface to define said opening for receiving the shaft, and wherein the at least one securing member secures the clamp member to the clamping portion of the weight carrier.

15. The weight training apparatus according to claim 14, including a first shaft gripping member of a resilient material extending along the first clamping surface and a second shaft gripping member of a resilient material extending along the second clamping surface.

16. A weight training apparatus for attachment to the shaft of a golf club, the golf club having a club head, the weight training apparatus comprising:

at least one weight;

a weight support assembly for coupling the at least one weight to the shaft, the weight support assembly including a weight carrier and a clamp member;

the weight carrier including a hollow body portion, the body portion being generally cylindrical in shape and having a first clamping surface, the clamp member having a second clamping surface opposing the first clamping surface, the first and second clamping surfaces defining an opening for receiving the shaft, and at least one securing member for securing the clamp member to the body portion, wherein the hollow body portion defines at least one cavity for containing the at least one weight.

17. The weight training apparatus according to claim 16, including a further weight, the further weight being coupled to and supported by the at least one weight.

18. The weight training apparatus according to claim 16, wherein the weight carrier includes a body portion, the body portion being generally cylindrical in shape and having a first clamping surface, the clamp member having a second clamping surface opposing the first clamping surface, the first and second clamping surfaces defining an opening for receiving the shaft, and at least one securing member for securing the clamp member to the body portion.

19. The weight training apparatus according to claim 18, wherein the body portion includes at least one cavity for containing the at least one weight.

20. The weight training apparatus according to claim 16, wherein the clamp member and the weight carrier include respective first and second opposing faces having respective first and second grooves which cooperate to define a shaft location opening, the first and second grooves being symmetrical and in-line within the first and second faces.

21. The weight training apparatus according to claim 16, including a further weight, and wherein the body portion includes a further cavity for containing the further weight.

* * * * *